US005515074A

United States Patent [19]

Yamamoto

[11] Patent Number: 5,515,074

[45] Date of Patent: May 7, 1996

[54] DENSITY CONTROL METHOD AND DEVICE IN DISPLAY DEVICE

[75] Inventor: Yoshihiko Yamamoto, Morioka, Japan

[73] Assignee: Alps Electric Co., Ltd., Tokyo, Japan

[21] Appl. No.: 361,625

[22] Filed: Dec. 22, 1994

[30] Foreign Application Priority Data

Dec. 27, 1993 [JP] Japan ..... 5-331655

[51] Int. Cl.[6] ..... G09G 3/36

[52] U.S. Cl. ..... 345/101; 359/86

[58] Field of Search ..... 345/101, 87, 63, 345/147, 117, 214, 212; 359/86, 84

[56] References Cited

U.S. PATENT DOCUMENTS

| | | | |
|---|---|---|---|
| 4,687,956 | 8/1987 | Itoh et al. | 345/101 |
| 4,825,201 | 4/1989 | Watanabe et al. | 345/147 |
| 4,888,599 | 12/1989 | Harwood | 345/101 |
| 5,024,982 | 7/1991 | Nash | 345/101 |
| 5,088,806 | 2/1992 | McCartney et al. | 345/101 |

*Primary Examiner*—Richard Hjerpe
*Assistant Examiner*—Regina Liang
*Attorney, Agent, or Firm*—Guy W. Shoup; Patrick T. Bever

[57] ABSTRACT

A density control device including a control section connected to a display device, for controlling a display density in a screen of the display device; a main memory connected to the control section for storing an updated density data for the screen; a data memory connected to the control section and preliminarily storing proper density data corresponding to temperatures; a temperature sensor connected to the data memory for detecting an environmental temperature of the display device during its use; and a data input-output device for performing input/output of density data to/from the main memory. When a power supply of the display device is turned on, the control section controls the display density in the screen according to either the updated density data stored in the main memory or the density data stored in the data memory corresponding to the environmental temperature detected by the temperature sensor, thus setting a desired display density. Accordingly, the display density in the screen can be automatically adjusted to a desired density.

4 Claims, 2 Drawing Sheets

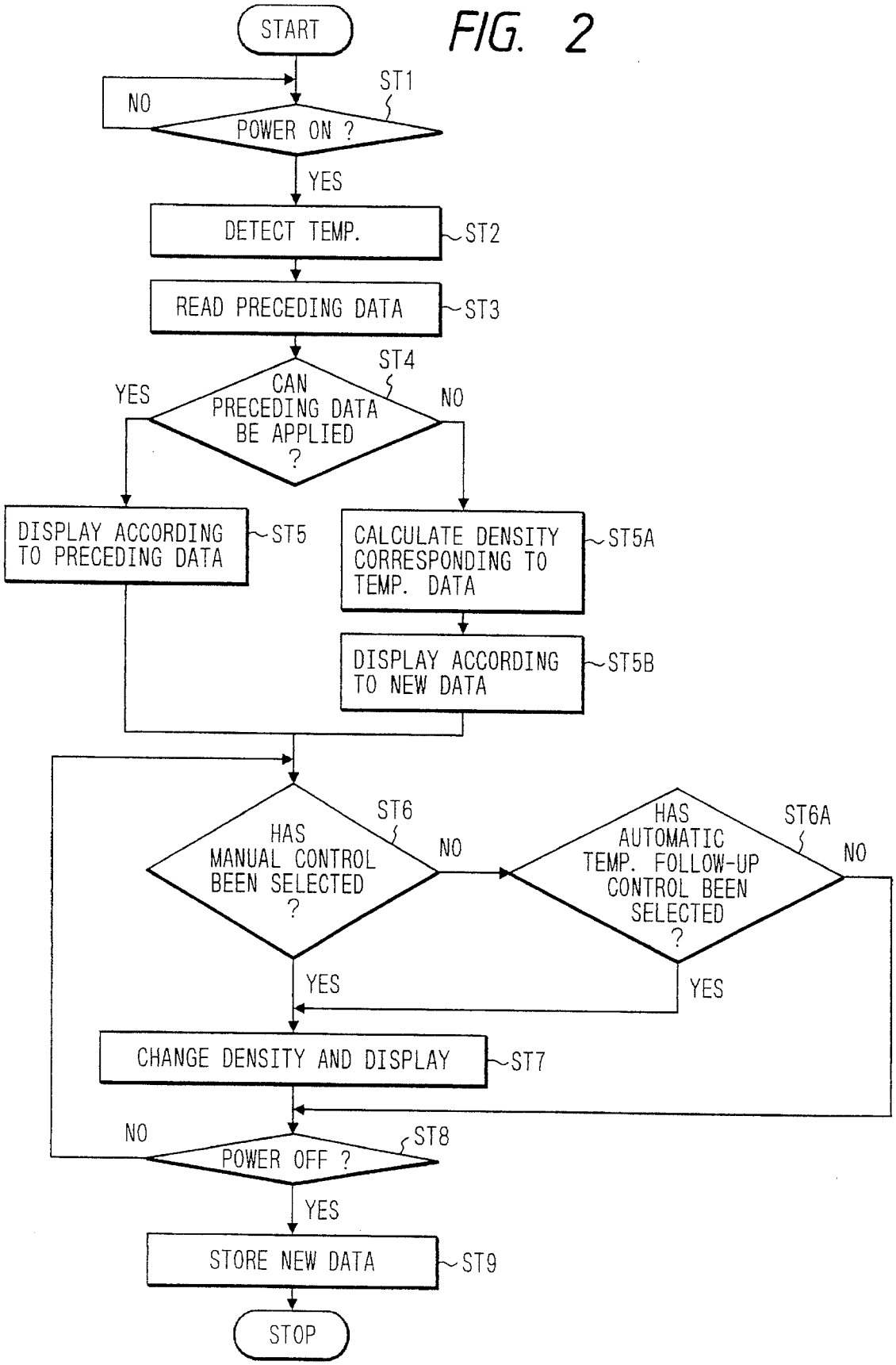
FIG. 2
START
ST1
NO
POWER ON ?
YES
DETECT TEMP.
ST2
READ PRECEDING DATA
ST3
ST4
YES
CAN PRECEDING DATA BE APPLIED ?
NO
DISPLAY ACCORDING TO PRECEDING DATA
ST5
CALCULATE DENSITY CORRESPONDING TO TEMP. DATA
ST5A
DISPLAY ACCORDING TO NEW DATA
ST5B
ST6
HAS MANUAL CONTROL BEEN SELECTED ?
NO
ST6A
HAS AUTOMATIC TEMP. FOLLOW-UP CONTROL BEEN SELECTED ?
NO
YES
YES
CHANGE DENSITY AND DISPLAY
ST7
NO
ST8
POWER OFF ?
YES
STORE NEW DATA
ST9
STOP

DENSITY CONTROL METHOD AND DEVICE IN DISPLAY DEVICE

BACKGROUND OF THE INVENTION

1. Field of the Invention

The present invention relates to a display device for displaying information in a personal computer, wordprocessor, etc., and more particularly to a density control method and device which can obtain a desired density in a display device such as a liquid crystal display having a screen whose display density is susceptible to an environmental temperature of the display device.

2. Description of the Prior Art

In a display device such as a liquid crystal display (LCD) mentioned above, the display density in a screen of the display device is susceptible to an environmental temperature of the display device in such a manner that the higher the environmental temperature, the higher the density in the screen as a whole.

This kind of display device is therefore provided with a volume for controlling the density, so that a desired density in the screen can be obtained by suitably rotating the volume.

However, in such a method for setting the display density in the screen by suitably rotating the volume, there is a possibility that the volume may be erroneously rotated in an off-state of a power supply of the display device to cause a phenomenon that the screen becomes while or black when the power supply is turned on. Further, also when the environmental temperature of the display device during its use largely changed even with no rotation of the volume, there is the possibility of the screen similarly becoming white or black.

When the screen of the display device becomes white or black as mentioned above, the user may mistake trouble with the display device. Further, even though the volume is so adjusted as to change the white or black condition of the screen into a normal density condition, slow response of the screen to this adjustment of the volume may cause the user to understand that the direction of the adjustment is wrong. Accordingly, there is a possibility that the user may repeatedly rotate the volume in both directions, causing troublesomeness in adjusting the density.

SUMMARY OF THE INVENTION

It is an object of the present invention to provide a density control method and device in a display device which can eliminate the above-mentioned problem in the prior art and automatically control the display density in the screen to a desired density.

According to an aspect of the present invention, there is provided a density control method in a display device having a screen whose display density is susceptible to an environmental temperature of the display device during its use, comprising the steps of detecting the environmental temperature by a temperature sensor upon turning on a power supply of the display device, and simultaneously reading a density data in a last condition of preceding operation of the display device from a memory; comparing the environmental temperature detected by the temperature sensor and a temperature corresponding to the density data in the last condition of the preceding operation; setting the display density in the screen according to the density data in the last condition of the preceding operation when a difference between the environmental temperature detected by the temperature sensor and the temperature corresponding to the density data falls within a predetermined range; and setting the display density in the screen according to the environmental temperature detected by the temperature sensor when the difference exceeds the predetermined range.

According to another aspect of the present invention, there is provided a density control device in a display device having a screen whose display density is susceptible to an environmental temperature of the display device during its use, comprising a control section connected to the display device for controlling the display density in the screen of the display device; a main memory connected to the control section for storing an updated density data for the screen; a data memory connected to the control section and preliminarily storing proper density data corresponding to temperatures; a temperature sensor connected to the data memory for detecting the environmental temperature; and a data input-output device for performing input/output of density data to/from the main memory; the control section controlling the display density in the screen according to one of the updated density data stored in the main memory and the density data stored in the data memory corresponding to the environmental temperature detected by the temperature sensor.

With the above-mentioned construction, when a power supply of the display device is turned off, for example, the updated density data for the screen is stored into the main memory by the operation of the data input-output device. When the power supply of the display device is turned on in the next time of use, the environmental temperature is detected by the temperature sensor. If the difference between the environmental temperature detected by the temperature sensor and the temperature corresponding to the updated density data is not large, the density in the screen is set according to the updated density data, whereas the difference is large, the density is set to a density corresponding to the environmental temperature detected by the temperature sensor.

BRIEF DESCRIPTION OF THE DRAWINGS

FIG. 2 is a flowchart showing a preferred embodiment of the density control method according to the present invention.

DETAILED DESCRIPTION OF THE PREFERRED EMBODIMENTS

Figure 1:
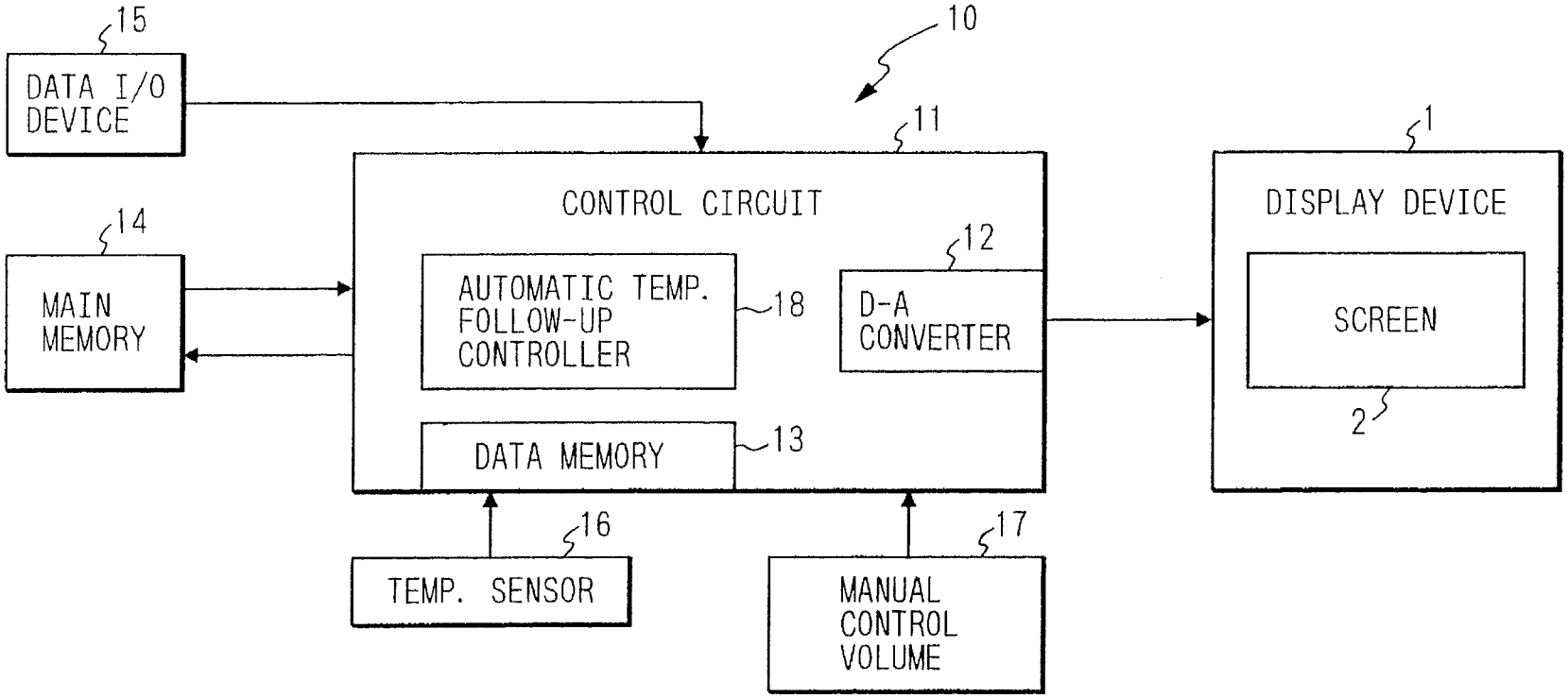
FIG. 1 is a block diagram showing a preferred embodiment of the density control device according to the present invention.

A preferred embodiment of the present invention will now be described with reference to the drawings.

Referring to FIG. 1, reference numeral 10 generally designates a density control device according to a preferred embodiment of the present invention. The density control device 10 includes a control circuit 11 connected to a display device 1 such as an LCD, for controlling the density in a screen 2 of the display device 1. The control circuit 11 constitutes a control section in the present invention. The control circuit 11 is formed by a one-chip CPU, and includes a D-A converter circuit 12 for outputting an analog control signal to the display device 1 and a data memory 13 preliminarily storing proper density data for the screen 2 corresponding to temperatures.

Connected to the control circuit 11 is a main memory 14 for storing an updated density data for the screen 2 of the display device 1 in its last condition of operation. The main memory 14 is formed by an $E^2$PROM, for example. Also connected to the control circuit 11 is a data input-output device 15 for performing input/output of density data to/from the main memory 14. The data input-output device 15 is interlocked with a main switch (not shown) of the display device 1 so that when the main switch of the display device 1 is turned off, the data input-output device 15 outputs a control signal to the control circuit 11 to store an updated density data in the last condition of operation of the display device 1 into the main memory 14, while when the main switch of the display device 1 is turned on, the data input-output device 15 outputs a control signal to the control circuit 11 to output the updated density data stored in the main memory 14 to the control circuit 11. Of course, even when the main switch of the display device 1 is turned off, the density data stored in the main memory 14 does not disappear.

A temperature sensor 16 for detecting an environmental temperature of the display device 1 during its use is connected to the data memory 13 in the control circuit 11.

Further, a manual control volume 17 for performing manual control (fine adjustment) of the density is connected to the control circuit 11, and the control circuit 11 further includes an automatic temperature follow-up controller 18 for automatically performing fine adjustment of the density with a change in environmental temperature of the display device 1 during its use.

Further, when the main switch of the display device 1 is turned off before the elapse of a given period of time, e.g., ten minutes, from the time of turning on the main switch, no new density data is stored into the main memory 14. This is due to the following reason. Even in the event that the manual control volume is erroneously rotated for fine adjustment at starting of the operation to render the screen 2 of the display device 1 while or black, it is intended that the density data in the last condition of the preceding operation stored in the main memory 14 can be reproduced by once turning off the main switch and then turning on the main switch.

The operation of the preferred embodiment constructed above will now be described with reference to the flowchart shown in FIG. 2. The main switch of the display device 1 is now in an off-state and the main memory 14 currently stores an updated density data in the last condition of the preceding operation of the display device 1.

In step ST1, if the main switch of the display device 1 is turned on for use in the above condition, an environmental temperature of the display device 1 is detected by the temperature sensor 16 as shown in step ST2. At the same time, the updated density data of the preceding operation stored in the main memory 14 is output to the control circuit 11 by the operation of the data input-output device 15 as shown in step ST3.

Then, as shown in step ST4, the temperature corresponding to the updated density data of the preceding operation output from the main memory 14 and the environmental temperature detected by the temperature sensor 16 are compared by the control circuit 11. If the difference between the temperature corresponding to the updated density data and the environmenal temperature is less than or equal to 20° C., for example, the density in the screen 2 of the display device 1 is set according to the updated density data in the last condition of the preceding operation as shown in step ST5. The density set above is converted into an alalog value by the D-A converter circuit 12 in the control circuit 11, and is then output to the display device 1. Accordingly, the density in the screen 2 of the display device 1 is set to a condition corresponding to the temperature in the last condition of the preceding operation of the display device 1.

However, there is a possibility that the density in the screen 2 set above may be slightly shifted from a desired condition because of the difference between the temperature corresponding to the updated density data in the preceding operation and the environmental temperature in the present operation, or there is a possibility that the density desired by a user in the present operation may differ from the density desired by another user in the preceding operation. In such cases, the density set above is sometimes desired to be finely adjusted.

Accordingly, it is determined in step ST6 whether or not manual control for the density in the screen 2 has been selected. If the manual control has been selected in step ST6, the program proceeds to step ST7, in which the density in the screen 2 of the display device 1 is changed to be set to a condition corresponding to the manual control, and is then output to the display device 1. Next in step ST8, it is determined whether or not the main switch of the display device 1 has been turned off. If the display device 1 is in operation, the program returns to step ST6, whereas if the operation of the display device 1 is over and the main switch is turned off, the program proceeds to step ST9, in which the updated density data in the last condition of the present operation is stored into the main memory 14 by the operation of the data input-output device 15. Then, the program is ended.

If the manual control has not be selected in step ST6, the program proceeds to step ST6A, in which it is determined whether or not the automatic temperature follow-up control function has been selected to automatically perform fine adjustment of the density for a change in environmental temperature during use. If the automatic temperature follow-up control function has been selected in step ST6A, the fine adjustment of the density for a change in environmental temperature during use is performed. If the automatic temperature follow-up control function has not been selected in step ST6A, the program proceeds to step ST8. Then, the program returns to step ST6 or proceeds to step ST9 as similarly to the above.

In step ST4, if the difference between the temperature corresponding to the density data in the last condition of the preceding operation output from the main memory 14 and the environmental temperature detected by the temperature sensor 16 is greater than 20°, for example, the program proceeds to step ST5A, in which the density in the screen 2 corresponding to the environmental temperature detected by the temperature sensor 16 is set in the data memory 13. Then, the program proceeds to step ST5B, in which the density thus set is converted into an analog value by the D-A converter circuit 12 in the control circuit 11, and is output to the display device 1. Accordingly, the density in the screen 2 of the display device 1 is set to a condition corresponding to the environmental temperature actually detected by the temperature sensor 16 in the present operation.

Then, in steps ST6, ST6A, and ST7, the manual control or the automatic temperature follow-up control is performed as required in a manner similar to the above. Then, the program proceeds to step ST8, in which it is determined whether or not the main switch of the display device 1 has been turned off. If the display device 1 is in operation, the program returns to step ST6, whereas if the operation of the display device 1 is over and the main switch is turned off, the program proceeds to step ST9, in which the updated density data in the last condition of the present operation is stored into the main memory 14 by the operation of the data input-output device 15. Then, the program is ended.

As described above, when the main switch is turned on, the density in the screen 2 is set in accordance with either the density data in the last condition of the preceding operation stored in the main memory 14 or the density data corresponding to the environmental temperature actually detected in the present operation. Accordingly, it is possible to avoid that the screen 2 of the display device 1 may become white or black. In other words, even when the environmental temperature of the display device 1 largely changes with a change in operation environment of the display device 1, an image is displayed on the screen 2 of the display device 1, thus eliminating the possibility that the user may mistake trouble with the display device 1. In addition, fine adjustment of the density can be simply performed in a short time.

It is to be noted that the present invention is not limited to the above preferred embodiment, but various modifications may be made as required.

According to the present invention as described above, the density in the screen of the display device can be automatically set to a desired density.

What is claimed is:

1. A density control method in a display device having a screen whose display density is susceptible to an environmental temperature of said display device during its use, comprising the steps of:

detecting said environmental temperature by a temperature sensor upon turning on a power supply of said display device, and simultaneously reading a density data in a last condition of preceding operation of said display device from a memory;

comparing said environmental temperature detected by said temperature sensor and a temperature corresponding to said density data in said last condition of said preceding operation;

setting said display density in said screen according to said density data in said last condition of said preceding operation when a difference between said environmental temperature detected by said temperature sensor and said temperature corresponding to said density data falls within a predetermined range; and setting said display density in said screen according to said environmental temperature detected by said temperature sensor when said difference exceeds said predetermined range.

2. A density control device in a display device having a screen whose display density is susceptible to an environmental temperature of said display device during its use, comprising:

a control section connected to said display device for controlling said display density in said screen of said display device;

a main memory connected to said control section for storing an updated density data for said screen;

a data memory connected to said control section and preliminarily storing proper density data corresponding to temperatures;

a temperature sensor connected to said data memory for detecting said environmental temperature; and a data input-output device for performing input/output of density data to/from said main memory;

said control section controlling said display density in said screen according to one of said updated density data stored in said main memory and said density data stored in said data memory corresponding to said environmental temperature detected by said temperature sensor.

3. A density control device according to claim 2, further comprising a manual control mechanism for performing manual control of said display density in said screen.

4. A density control device according to claim 2, further comprising automatic temperature follow-up control means for automatically performing fine adjustment of said display density with a change in said environmental temperature of said display device during its use.

* * * * *